US006588954B2

(12) United States Patent
Verhoest et al.

(10) Patent No.: US 6,588,954 B2
(45) Date of Patent: Jul. 8, 2003

(54) INK JET PRINTER EQUIPPED FOR AVOIDING UNDESIRED BELT MOVEMENT

(75) Inventors: Bart Verhoest, Niel (BE); Hilbrand Vanden Wyngaert, Grobbendonk (BE); Dirk De Ruijter, Deurne (BE); Bart Verlinden, Tongeren (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/785,002

(22) Filed: Feb. 16, 2001

(65) Prior Publication Data

US 2002/0159813 A1 Oct. 31, 2002

Related U.S. Application Data

(60) Provisional application No. 60/188,947, filed on Mar. 13, 2000.

(30) Foreign Application Priority Data

Feb. 23, 2000 (EP) ..... 00200622

(51) Int. Cl.[7] ..... B41J 13/02

(52) U.S. Cl. ..... 400/635; 400/634; 271/275; 271/276

(58) Field of Search ..... 400/634, 120.01, 400/118.2, 56, 55, 58, 635; 271/275, 276

(56) References Cited

U.S. PATENT DOCUMENTS

| | | | | | |
|---|---|---|---|---|---|
| 4,469,026 | A | | 9/1984 | Irwin | 101/426 |
| 5,712,672 | A | | 1/1998 | Gooray et al. | 347/102 |
| 5,784,676 | A | * | 7/1998 | Iseki et al. | 347/116 |
| 5,854,643 | A | * | 12/1998 | Katsuyama | 271/7 |
| 5,966,145 | A | | 10/1999 | Miura et al. | |
| 6,068,374 | A | * | 5/2000 | Kurata et al. | 347/100 |
| 6,106,090 | A | * | 8/2000 | Uchida et al. | 347/104 |
| 6,224,204 | B1 | * | 5/2001 | Aoki | 347/106 |

FOREIGN PATENT DOCUMENTS

| | | | | |
|---|---|---|---|---|
| JP | 11020973 A | * | 1/1999 | B41J/11/02 |
| WO | WO 99/11551 | | 3/1999 | |

* cited by examiner

*Primary Examiner*—Daniel J. Colilla
(74) *Attorney, Agent, or Firm*—John A. Merecki; Hoffman, Warnick & D'Alessandro

(57) ABSTRACT

An ink jet printer wherein a belt transports an image receiving member past a printhead is equipped with guiding means (18) for creating a bulge, d, in the belt, extending towards the ink ejecting means, thus keeping the "throw distance" constant and/or with rollers for moving the belt, one of the rollers having a flange and being positioned so as to force the belt agains the flange.

10 Claims, 3 Drawing Sheets

(a)

(b)

INK JET PRINTER EQUIPPED FOR AVOIDING UNDESIRED BELT MOVEMENT

The application claims the benefit of U.S. Provisional Application No. 60/188,947, filed Mar. 13, 2000.

FIELD OF THE INVENTION

The present invention relates to an apparatus and a method for printing images; the invention especially concerns the printer configuration. The invention is particularly suitable for ink-jet printing using a belt for conveying an image receiving substrate.

BACKGROUND OF THE INVENTION

In many ink jet printers, transport of the image receiving substrate in one or the other stage of the printing process, proceeds by a belt, c.q. a vacuum belt.

E.g. U.S. Pat. No. 4,469,026 discloses a printer having a sheet fed and drum transport assembly. Ink is applied to a sheet while it is transported by the drum. Subsequently, the receiving substrate is detached from the drum and conveyed by a vacuum belt past a dryer.

In U.S. Pat. No. 5,712,672 a printer is disclosed wherein sheets are transported by means of a vacuum belt past an ink-jet printhead and through a microwave dryer.

Patent application WO 99/11551 discloses a printer wherein sheets are transported by a vacuum drum. A simplex printer has one vacuum drum, while a duplex printer uses two counter-rotating drums. In a duplex printer, a first image is printed on one side of a paper sheet while the sheet is on the first drum; then the paper is fed to the second drum so that the first printed image contacts the second drum, and a second image is printed on the opposite side of the paper. The printer can also be used to print on a continuous web instead of on separate sheets.

Printers wherein the image receiving substrate passes the printhead while it is carried by a belt (a vacuum belt as well as a non-vacuum belt) can have problems with keeping the "throw distance"—i.e. the distance that the ink has to travel between the ink application means, for instance an ink-jet nozzle, and the receiving substrate—constant while such a belt can show movement to and away from the printhead, vertical movement. It is also possible that, during operation of the printer, such a belt not only shows a vertical movement, but also some lateral movement, so that the registering of colour selection of the image to be printed on the receiving substrate is not as good as it should be.

In U.S. Pat. No. 5,966,145 it is disclosed to support the belt underneath the printhead so as to avoid the movement to and away from the printhead. The support is in sliding contact with the belt and does not add to the tensioning of the belt, so that problems with wear of the belt due to the sliding contact exist and since the supports do not add to the tension of the belt, the problems of vibration sill exist.

Thus it is still desired to have means and ways available to minimise and even totally avoid undesired movement of the vacuum belt, without excessive wear of the belt.

OBJECTS AND SUMMARY OF THE INVENTION

It is an object of the invention to provide an ink jet printer with a belt for transporting an image receiving substrate comprising means for minimising or even avoiding undesired movements of the belt that can deteriorate the image quality of the printed image.

It is a further object of the invention to provide an ink jet printer with a belt for transporting an image receiving substrate comprising means for minimising or even avoiding undesired vertical movement of the belt so as to have a constant "throw distance".

It is an other object of the invention to provide an ink jet printer with a belt for transporting an image receiving substrate comprising means for minimising or even avoiding lateral movement of the belt so as to have a good registering of colour selections of the image to be printed on the receiving substrate.

The first object of the invention is realised by providing an ink jet printer comprising an ink ejecting means (11), a belt (14) for passing a receiving substrate (20) near said ink ejecting means and a first and a second roller (13, 15) for moving said belt (14) in the sense of arrow A, each of said rollers having a first and a second end and an axis **(13*a*, 15*a*), characterised in that said belt (14) contacts a guiding means (18), placed between said first and second roller, for creating a bulge, d, in said belt (14), extending towards said ink ejecting means (11)**.

The second object of the invention is realised by providing an ink jet printer comprising an ink ejecting means (11), a belt (14) for passing a receiving substrate (20) near said ink ejecting means and a first and a second roller (13, 15) for said moving said belt (14) in the sense of arrow A, each of said rollers having a first and a second end and an axis **(13*a*, 15*a*), characterised in that said first roller (13) has flanges (13*b*) at said first and second end and is placed in said printer so that it deviates from parallelism with said second roller (15)**.

In a very preferred embodiment of this invention there is provided an ink jet printer comprising an ink ejecting means (11)

a belt (14) for passing a receiving substrate (20) near said ink ejecting means (11) and a first and a second roller (13, 15) for said moving said belt (14) in the sense of arrow A, each of said rollers having a first and a second end and an axis **(13*a*, 15*a*), characterised in that said first roller (13) has flanges (13*b*) at said first and second end and is placed in said printer so that it deviates from parallelism with said second roller (15) and said belt (14) contacts a guiding means (18), placed between said at least two rollers, for creating a bulge, d, in said belt, extending towards said ink ejecting means (11)**.

BRIEF DESCRIPTION OF THE DRAWINGS

FIG. **1*a*** shows schematically a belt moving over two rollers and with a guiding means creating a bulge in the belt.

FIG. **1*b*** shows an enlarged portion (circle B) of the guiding means, showing the angle over which the belt forms an arc.

DETAILED DESCRIPTION OF THE INVENTION

In an ink jet printer with a belt for transporting an image receiving substrate there can be different undesired movements:

undesired vertical movement of the belt causing the "throw distance" to vary undesired lateral movement of the belt causing misregistering of colour separations.

In a monochrome printer, the problem of misregistering is less important and it may be sufficient to have an high quality printer when the "throw distance" is kept constant. In a multicolour printer, using a short belt, it may be that the undesired vertical movement does not exist and that only means for avoiding undesired lateral movement of the belt are necessary. In a multicolour printer using a longer belt it may that means have to be incorporated for avoiding both the vertical movement and the lateral movement of the belt.

The 'throw-distance' is the distance that the ink has to travel between the ink application means, for instance an ink-jet nozzle, and the receiving substrate. When using a belt to transport a receiving substrate past ink application means, the belt may move slightly towards or away from the ink application means during the ink application, due to disturbances in the movement of the belt. This movement causes the throw-distance to change over time, and this changing "throw distance" results in lower print quality.

Figure 1:
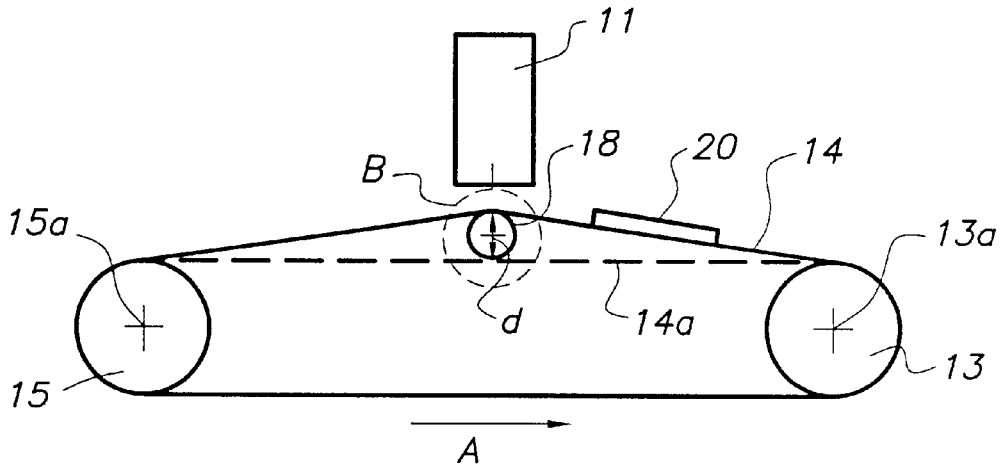
Figure 1:
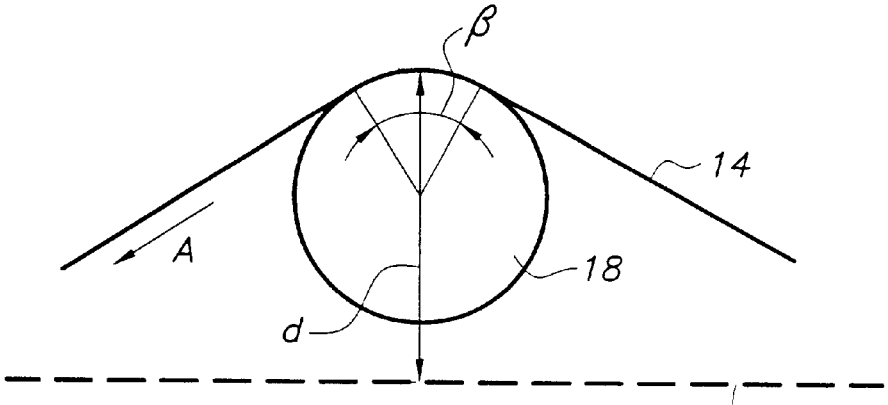

In FIG. 1 a means to minimise and even avoid the undesired movement of the belt to and from the printhead, i.e. the vertical movement is shown. A belt (14), carrying an image receiving substrate (20) moves in the direction of arrow A over a first and second roller (13, 15), each of said rollers having an axis (13*a*, 15*a*). A guiding means (18) is placed at the location where ink is applied onto the receiving substrate (20) in such a way that the belt passes between the guiding means and an ink ejection means (11) (further on indicated by the wording "printhead"). The guiding means (18) is placed so that the belt is pushed towards the printhead (11) away from the position (14*a*) it would have when no guiding means is present. Thus the guiding means creates a bulge, d, in the belt, elevating the belt from the position the belt would have without guiding means towards the printhead (11).

The guiding means (18) is preferably designed so as to avoid sliding contact between the belt and the guiding means, therefore include any kind of rotatable member. But most preferably it includes a small roller (with diameter smaller than the diameter of the rollers (13, 15)), with an axis substantially parallel to the axis of rollers (13, 15) in FIG. 1*a*. When the guiding means (18) is designed as a single roller, it may guide the belt over convex arc covering an angle, β, between 0 and 90°, both limits included. It is preferred that it guides the belt over a small convex arc covering an angle of e.g. 1° to 5°, or even smaller than 1°. In a very preferred embodiment, said angle β is such that 15"≦β≦5°. This angle is shown in FIG. 1*b* (an enlargement of part of FIG. 1*a*, the numericals in FIG. 1*b* have the same meaning as those in FIG. 1*a*).

Figure 2:
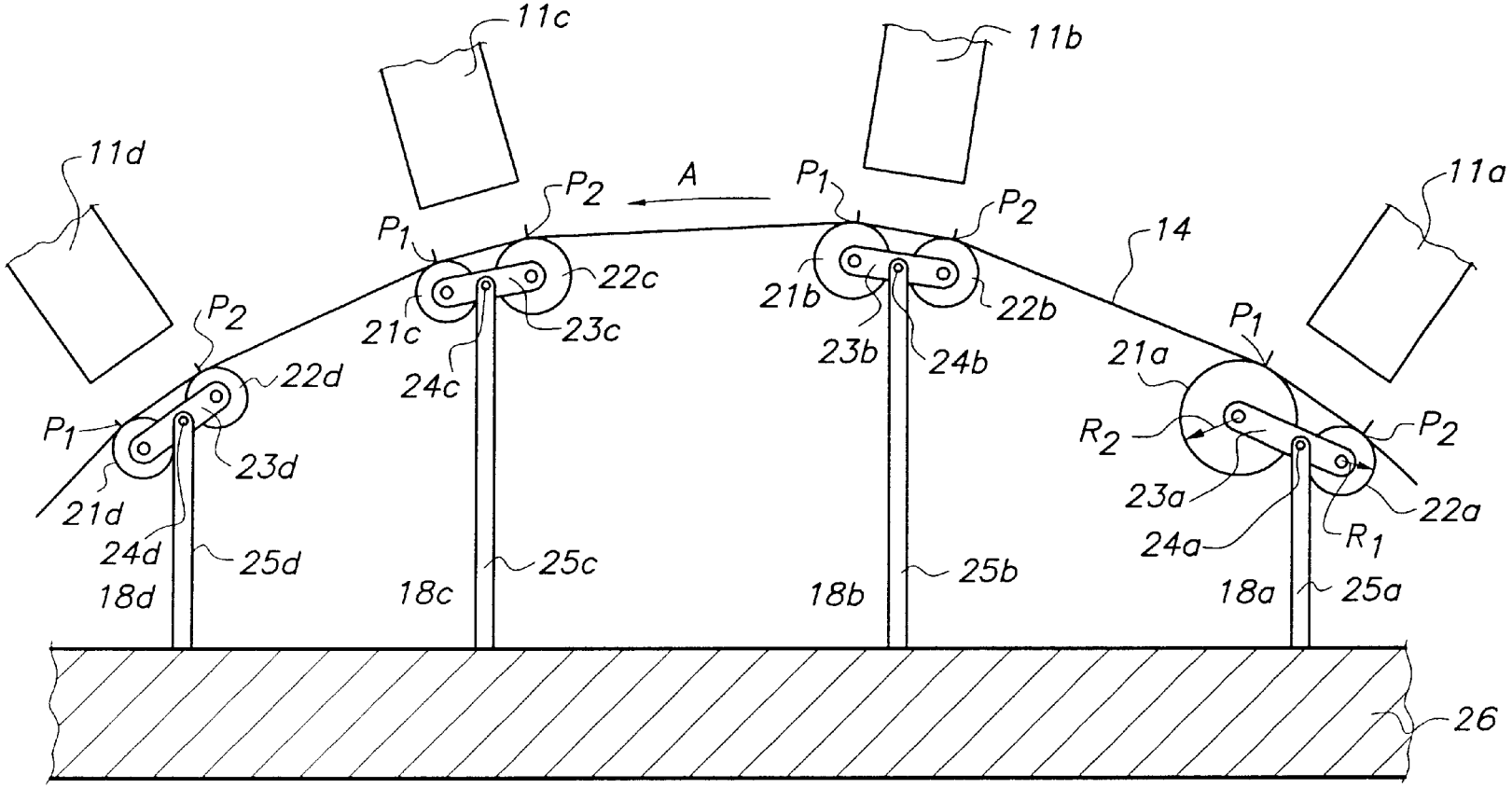
FIG. 2 shows schematically a belt and a guiding means comprising two rollers.

The guiding means used in this invention can very beneficially be designed to incorporate at least two rollers that are placed quite close together so that on top of the two rollers the belt is kept in a straight line. When then the printhead is placed above the guiding means, a printhead with several rows of nozzles can be accommodated above the guiding means and the throw distance for each of the rows of nozzles is kept constant, since the belt and the image receiving substrate on it are in a straight line under the rows of nozzles. Such guiding means are shown in FIG. 2, wherein portion of a full colour printer, incorporating a belt (14) and guiding means (18*a*, 18*b*, 18*c* and 18*d*) is shown. The belt (14) passes over guiding means (18*a*, 18*b*, 18*c* and 18*d*) in the direction of arrow A. Each of the guiding means comprises two rollers ((21*a*, 22*a*), (21*b*, 22*b*), (21*c*, 22*c*), (21*d*, 22*d*)), said rollers having a radius R1 and R2. In the FIG. 2 the radii of the rollers are only shown for guiding means 18*a*. The rollers in the guiding means are coupled to each other by a coupling means (23*a*, 23*b*, 23*c* and 23*d*) said coupling means being connected to a support (25*a*, 25*b*, 25*c* and 25*d*) so as to be movable around a connection means (24*a*, 24*b*, 24*c* and 24*d*) The supports (25*a*, 25*b*, 25*c* and 25*d*) are placed on a frame (26) in the printer so as to keep the belt (14) tensioned by each of the guiding means (18*a*, 18*b*, 18*c* and 18*d*) and to create 4 straight portions in the belt. Over each of said straight portions of the belt a printhead (11*a*, 11*b*, 11*c* and 11*d*) is positioned so that the nozzle plate of the printhead, having one or more arrays of nozzles, is parallel to each of said straight portions of the belt. The rollers (21*a*, 22*a*, 21*b*, 22*b*, 21*c*, 22*c*, 21*d*, 22*d*) in the guiding means ((18*a*, 18*b*, 18*c* and 18*d*) can have a different or an equal diameter depending on the needs of the design of the printer. In each of the guiding means, the diameter of the rollers and the distance between the axis of the two rollers (18*a*) is adapted so as to have a good compromise between the length of the straight portion of the belt between points P1 and P2, the risk that the belt gets a vertical movement in that straight portion and the extension of the rows of nozzles in the nozzle plate. Preferably the distance between the two axis is larger than (R1+R2) and smaller than 2 times (R1+R2).

Preferably, means are provided to tighten the belt and to ensure that the belt contacts the guiding means (18). In a first embodiment, the tightening means are vacuum applicators; a first vacuum applicator is located downstream and adjacent to the guiding means and a second vacuum applicator is located upstream and adjacent to the guiding means; the forces exerted by both vacuum applicators on the belt tighten the belt against the guiding means. In a second embodiment, the tightening means may be located anywhere along the belt and provide an adequate belt tension in the complete belt, while the guiding means have protruding positions as shown in FIGS. 1*a* and 2. This second embodiment may be combined with the first one, i.e. vacuum applicators may be used to tighten the belt in the second embodiment.

The means according to this invention for avoiding vertical movement of the belt offer several advantages:

even when a long belt is used—the longer the belt, the more prone it is to vertical movement—the vertical movement can be avoided without necessitating high tension on the belt, because lower tension can be used the wear of the belt is minimised the means for avoiding vertical movement can easily be adapted to the number of rows of nozzles in the nozzle plates of the printheads the means and ways of this invention for keeping the throw-distance constant are applicable to carriage-type printers and to page-width type printers, to monochrome printers with only one printhead as well as to full colour printers and the means for avoiding vertical movement can be used with any type of belt, it can be used by a belt tensioned with resilient means, it can be used with a vacuum belt, it can be used with a belt made of metal as well as with a belt made of polymeric material or cloth.

In an ink jet printer, using a belt for transporting the image receiving substrate to the printhead(s), it is not only necessary to keep the throw distance constant, but also a good registering of colour selection of the image to be printed on the receiving substrate has to be achieved. This registering can be compromised by lateral movement of the belt.

Figure 3:
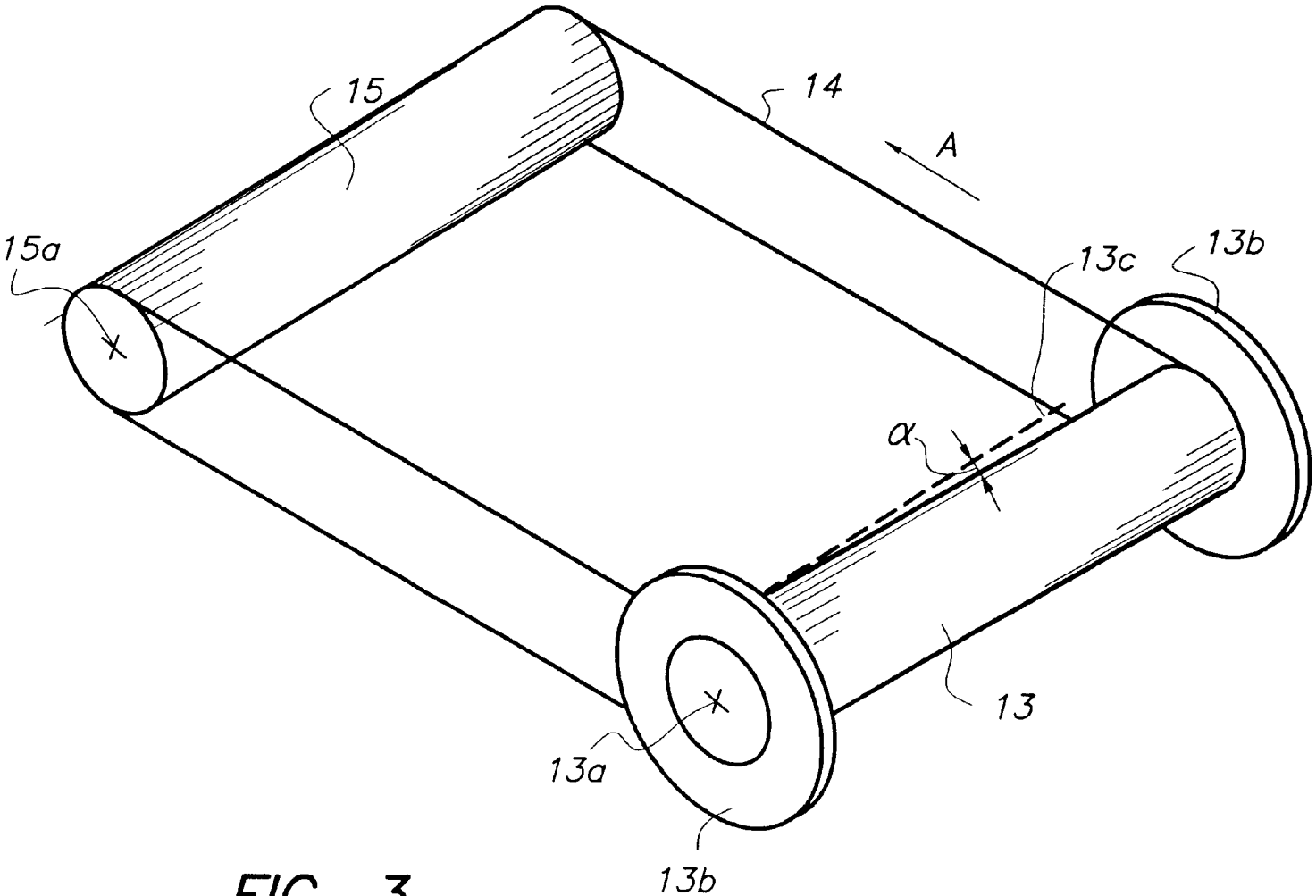
FIG. 3 shows schematically the placement of two rollers, one with a flange and not being parallel with each other.

It was found that when one of the rollers for moving the belt has at one end of the roller a flange and is placed in said printer so that it is, not parallel with the other roller(s) for moving the. belt, then the belt is always forced against the flange when the roller deviates from the parallelism over a well chosen angle $\alpha$. By forcing the belt against the flange, the belt is kept moving without undesired lateral movement. Although the roller may have flanges at both ends (as shown in FIG. 3) and more than one roller may have one or two flanges, it is sufficient for avoiding undesired lateral movement of the belt that one roller has one flange, since it is possible by making a judicious choice of the angle $\alpha$ to force the belt against the single flange. When more than one roller has flanges it is beneficial in the construction of an ink jet printer of this invention to make sure that the belt is only forced against one of the flanges. The size of the angle $\alpha$ is chosen so as to force the belt against the flange for avoiding lateral movement of the belt and so as to avoid too much friction of the belt against that flange. The sign of the angle $\alpha$ can be positive as well as negative and determines which flange is touched by the belt. Further on in this text when the size of angle $\alpha$ is mentioned, it is mentioned without its sign as its absolute value, $|\alpha|$.

In FIG. 3 this is schematically illustrated. A belt (14)—for sake of clarity shown as being transparent—moves in direction of arrow A over two rollers (13, 15) with axis (13*a*, 15*a*). A first roller (13) has flanges (13*b*) a both ends and is placed so as to be not parallel with the second roller (15). The line 13*c* shows the position of the first roller when it would be placed parallel. The first roller deviates from the parallelism with the second one over an angle $\alpha$, chosen such that $15'' \leqq |\alpha| \leqq 5°$. Preferably $\alpha$ is chosen such that $15'' \leqq |\alpha| \leqq 2°$. The flanges (13*b*) on the first roller can be separate from the roller and simply clipped over the roller, or can be an integral part of the roller, when the roller is machined so as to have flanges incorporated directly. The form and height of the flanges is dictated by the belt, the tension on the belt, etc. and can easily be adapted to fulfil their purpose: forcing the belt against one of flanges and thus keeping it moving in the direction of arrow A, without undesired lateral movement.

As explained above it may be necessary in some printers to combine the means according to this invention for avoiding the undesired vertical movement with the means according to this invention for avoiding the undesired lateral movement of the belt.

Therefore this invention incorporates an ink jet printer comprising an ink ejecting means (11), a belt (14) for passing a receiving substrate (20) near said ink ejecting means and a first and a second roller (13, 15) for said moving said belt (14) in the sense of arrow A, each of said rollers having a first and a second end and an axis (13*a*, 15*a*), characterised in that said first roller (13) has a flange (13*b*) at said first end and is placed in said printer so that it deviates from parallelism with said second roller (15) over an angle $\alpha$ chosen so that said belt is forced against said flange and said belt (14) contacts a guiding means (18*a*), placed between said at least two rollers, for creating a bulge, d, in said belt.

Parts List

11 ink ejecting means (printhead)
13, 15 rollers
13*a*, 15*a* axis of rollers 13 and 15
13*b* flange
14 belt
18, 18*a*, 18*b*, 18*c*, 18*d* guiding means
21*a*, 21*b*, 21*c*, 21*d*, 22*a*, 22*b*, 22*c*, 22*d* rollers in the guiding means
23*a*, 23*b*, 23*c*, 23*d* coupling means
24*a*, 24*b*, 24*c*, 24*d* connection means
25*a*, 25*b*, 25*c*, 25*d* support
26 frame

What is claimed is:

1. An ink jet printer comprising an ink ejecting means, a belt for passing a receiving substrate near said ink ejecting means, and a first and a second roller for moving said belt past said ink ejecting means, each of said rollers having a first and a second end and an axis, wherein said first roller has a flange at said first end and is placed in said printer so that said axis of said first roller deviates from parallelism with said axis of said second roller over a fixed angle $\alpha$ chosen for forcing said belt against said flange.

2. An ink jet printer according to claim 1, wherein said angle $\alpha$ is chosen so that $15'' \leqq |\alpha| \leqq 2°$.

3. An ink jet printer according to claim 2, wherein said belt contacts a guiding means, placed between said first and said second roller, for creating a bulge in said belt.

4. An ink jet printer according to claim 3, wherein said guiding means comprises at least two rollers coupled to each other by a coupling means, said coupling means being connected to a support so as to be movable around connection means.

5. An ink jet printer according to claim 3, wherein said guiding means comprises a single roller, placed between said first and said second roller, for guiding said belt over a convex arc covering an angle $\beta$ chosen so that $0° \leqq \beta \leqq 90°$, and wherein said ink ejecting means has a position for applying ink onto said receiving substrate at a location along said convex arc.

6. An ink jet printer according to claim 1, wherein said belt contacts a guiding means, placed between said first and said second roller, for creating a bulge in said belt.

7. An ink jet printer according to claim 6, wherein said guiding means comprises at least two rollers coupled to each other by a coupling means, said coupling means being connected to a support so as to be movable around connection means.

8. An ink jet printer according to claim 6, wherein said guiding means comprises a single roller, placed between said first and said second roller, for guiding said belt over a convex arc covering an angle $\beta$ chosen so that and wherein said ink ejecting means has a position for applying ink onto said receiving substrate at a location along said convex arc.

9. An ink jet printer comprising an ink ejecting means, a belt for passing a receiving substrate near said ink ejecting means, and a first and a second roller for moving said belt past said ink ejecting means, each of said rollers having a first and a second end and an axis, wherein said belt contacts a single roller, placed between said first and said second roller, for guiding said belt over a convex arc covering an angle $\beta$ chosen so that $0° \leqq \beta \leqq 90°$, and wherein said ink ejecting means has a position for applying ink onto said receiving substrate at a location along said convex arc directly above an axis of said single roller.

10. An ink jet printer according to claim 9, wherein said angle $\beta$ is chosen so that $15'' \leqq \beta 5°$.

* * * * *

UNITED STATES PATENT AND TRADEMARK OFFICE

CERTIFICATE OF CORRECTION

PATENT NO. : 6,588,954 B2
DATED : July 8, 2003
INVENTOR(S) : Verhoest et al.

It is certified that error appears in the above-identified patent and that said Letters Patent is hereby corrected as shown below:

Column 6,

Line 47, after "that", insert -- $0^{\circ} \leqq ß \leqq 90^{\circ}$ --;

Line 65, after "ß", second occurrence, insert -- $\leqq$ --.

Signed and Sealed this

Sixteenth Day of March, 2004

JON W. DUDAS
*Acting Director of the United States Patent and Trademark Office*